United States Patent [19]

Ellerbrock

[11] 4,289,265

[45] Sep. 15, 1981

[54] COMPOSITE END CONSTRUCTION FOR COMPOSITE CONTAINERS, SUCH AS OIL CANS

[75] Inventor: Donald H. Ellerbrock, Florissant, Mo.

[73] Assignee: Boise Cascade Corporation, Boise, Id.

[21] Appl. No.: 107,891

[22] Filed: Dec. 28, 1979

[51] Int. Cl.[3] ..... B65D 3/10

[52] U.S. Cl. ..... 229/5.5; 229/5.6

[58] Field of Search ..... 229/5.5, 4.5, 5.6, 5.8, 229/3.1

[56] References Cited

U.S. PATENT DOCUMENTS

| | | | |
|---|---|---|---|
| 1,633,884 | 6/1927 | Bennett et al. | 229/5.5 |
| 2,227,138 | 12/1940 | Karl | 229/5.6 |
| 2,356,401 | 8/1944 | Hatch | 229/5.5 |
| 2,618,428 | 11/1952 | Harrison | 229/5.6 |
| 2,677,318 | 4/1954 | Torudd et al. | 93/1.3 |
| 3,357,626 | 12/1967 | Carpenter | 220/461 |
| 3,381,594 | 5/1968 | Ellenbrock et al. | 229/5.6 X |
| 3,391,847 | 7/1968 | Christine et al. | 229/43 |
| 3,406,891 | 10/1968 | Bachner et al. | 229/4.5 X |
| 3,722,732 | 3/1973 | Edlund | 229/5.5 X |
| 3,949,927 | 4/1976 | Smith et al. | 229/4.5 X |

*Primary Examiner*—Davis T. Moorhead

*Attorney, Agent, or Firm*—Laubscher, Philpitt & Laubscher

[57] ABSTRACT

This invention relates to a composite container for liquids, such as oil, including a generally tubular vertically arranged fibrous body wall, a flexible impervious membrane-type closure member closing the bottom end of the body wall, and an outer support cap for supporting in protective relation the membrane closure member. The end closure member includes an annular peripheral flange portion that is arranged concentrically within, and is bonded to the inner surface of, the fibrous body wall, which flange portion extends longitudinally upwardly of the container from a central disk portion that extends transversely across the body wall adjacent the lower end thereof. The support cap includes a central disk portion that extends in supporting relation beneath the central portion of the membrane closure member, and a peripheral flange portion that extends concentrically about, and is bonded to the external surface of, the fibrous body wall.

12 Claims, 2 Drawing Figures

COMPOSITE END CONSTRUCTION FOR COMPOSITE CONTAINERS, SUCH AS OIL CANS

BRIEF DESCRIPTION OF THE PRIOR ART

Composite containers including composite end closure means are well known in the patented prior art, as evidenced, for example, by the patents to Torudd et al U.S. Pat. No. 2,677,318, Carpenter et al U.S. Pat. No. 3,357,626, Christine et al U.S. Pat. No. 3,391,847 and Smith et al No. 3,949,927. Owing to the use of composite stock material in the body walls and/or end closure members, these containers are less costly and considerably lighter than corresponding metal containers.

One problem inherent in composite containers designated for packaging liquids such as oil is that of producing a leak-proof joint or seam between the end closure member and the body wall member, so that the container will satisfactorily withstand the deleterious shock and impact forces and stresses that are produced during handling, stacking and/or dropping of the containers.

SUMMARY OF THE INVENTION

Accordingly, a primary object of the present invention is to provide an improved composite container which is particularly suitable for the packaging of liquids, such as motor oil. The composite container includes a generally tubular composite body member having at least one fibrous body wall layer and an inner liner layer, a thin membrane-type end closure member closing the bottom end of said body member, and an outer support cap mounted on the body member in protective supporting relation to the membrane closure member. The inner end closure member, which is made from a thin flexible fluid-impervious material (such as metal foil or synthetic plastic material) includes a generally disk-shaped horizontal central panel portion located in protective supporting relation adjacent the lowermost extremity of the body member, and a peripheral annular flange portion which is concentrically arranged within, and is bonded to the inner circumferential surface of, the body member liner layer. The outer support cap—which has at least one fibrous layer—includes a generally disk-shaped horizontal central portion extending beneath the central panel portion of the end closure member, and a peripheral flange portion which extends concentrically about, and is bonded to the outer circumferential surface of, the body member end. The horizontal central panel portions of the inner closure member and the outer support cap are substantially parallel and adjacent so that when the container is stacked, roughly handled or accidentally dropped, pressure which is exerted on the flexible inner closure member by the container liquid contents is absorbed by the outer support cap, thereby protecting the integrity of the joint. Furthermore, because the closure member is made from a flexible material, it will flex slightly in response to pressures from handling, stacking or dropping instead of splitting or tearing away from the body member inner liner layer. The outer support cap, which includes at least one fibrous layer, such as paperboard, provides the necessary support and protection for the inner closure member.

The end closure member and outer support cap are formed from generally circular pieces of conventional composite stock materials which are then heat bonded to the fibrous body member dielectrically by the use of radio frequency energy, or by heat conduction.

Preferably, the body member inner liner layer and/or the support cap inner layer are formed from a suitable thermoplastic material, such as polyethylene, so that it is not necessary to add bonding material to the container end prior to or during the heat bonding step.

It is therefore a further object of the present invention to provide an improved composite container which may be easily and inexpensively manufactured.

Another object of the invention is to provide a lightweight composite container which has excellent leakproof structural characteristics.

BRIEF DESCRIPTION OF THE DRAWING

Other objects and advantages of the invention will become apparent from a study of the following specification when viewed in light of the accompanying drawing, in which.

DETAILED DESCRIPTION OF THE INVENTION

Figure 1:
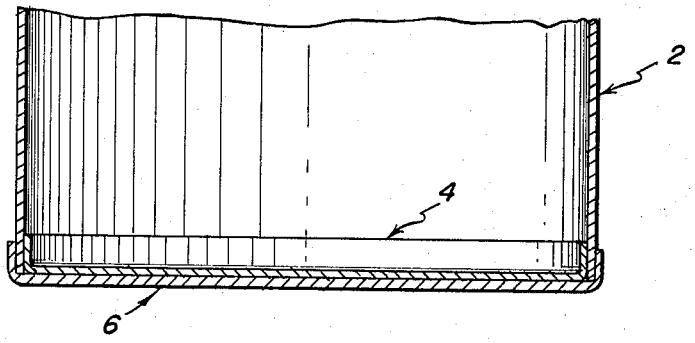
FIG. 1 is a cross-sectional view of the bottom end of the composite container of the present invention.
Figure 2:
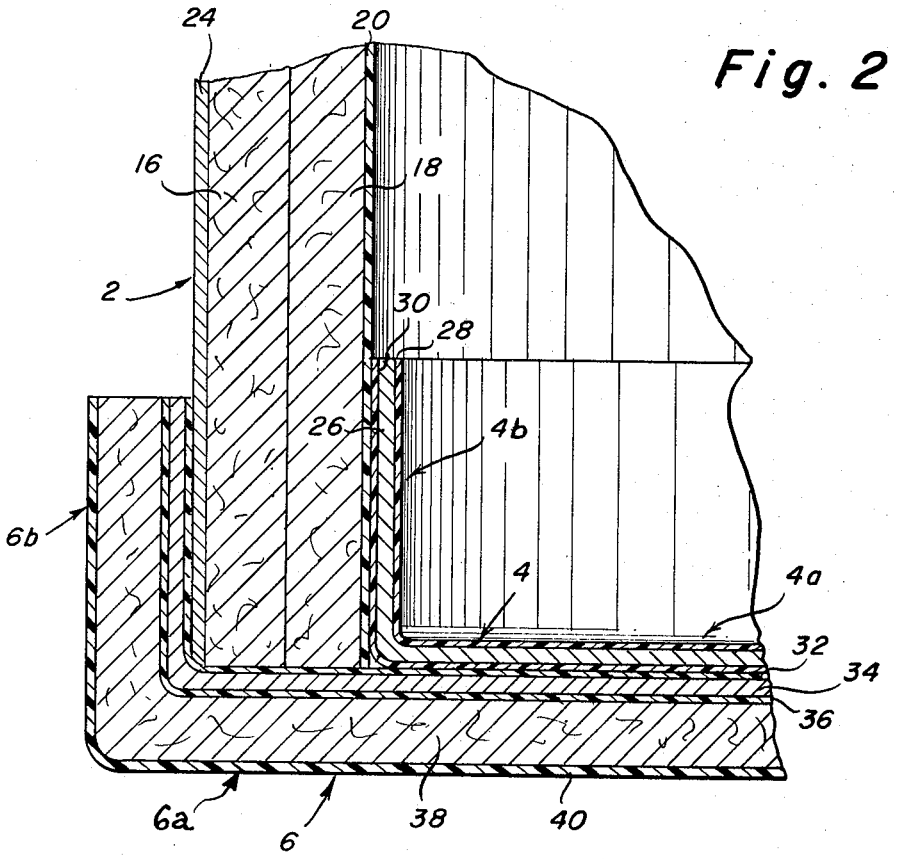
FIG. 2 is a detailed cross-sectional view of the container of FIG. 1.

Referring first to FIG. 1, the composite container of the present invention includes a generally tubular composite body member 2, a fluid-impervious membrane-type inner end closure member 4, and an outer support cap 6. As shown in FIG. 2, the inner end closure member 4 includes a generally disk-shaped horizontal central panel portion 4*a*, and a peripheral annular flange portion 4*b* which extends concentrically within, and is bonded to the inner circumferential surface of, the body member 2. The outer end cap member 6 includes a generally circular horizontal central panel portion 6*a*, and an annular flange portion 6*b* which is bonded to the outer circumferential surface of the body member 2.

In the preferred embodiment illustrated in FIG. 2, the composite body member 2 includes a pair of fibrous layers 16 and 18, an inner liner layer 20 of heat sealable material, such as polyethylene, and a label layer 24 bonded to the fibrous layer 16. The membrane-type end closure member 4 includes a layer 26 of metal foil, such as aluminum, and inner and outer synthetic plastic layers 28 and 30, respectively, formed of polyethylene, vinyl, polyesters or propylene. The outer support cap 6 includes an inner bonding layer 32 (for example, polyethylene), a metal foil layer 34, a bonding layer 36 (for example, polyethylene), a fibrous layer 38, and a protective layer 40. The end closure member 4 and outer support cap 6 are heat sealed to the body member 2 (i.e., by the use of radio frequency energy, dielectric energy or conductive heat).

During assembly of the container, a generally disk-shaped end closure member is cut from appropriate stock material and inserted into one end of the composite body member. During insertion of the closure member, it is deformed to define a generally disk-shaped horizontal central panel portion which is located at the lower extremity of the body member, and a peripheral flange portion which is concentrically arranged within, and is heat sealed to, the container inner liner layer. The outer support cap is then applied to the same end of the container and is folded to define a horizontal central panel portion, and a peripheral flange portion which extends concentrically about, and is heat sealed to the outer surface of, the fibrous body wall. The inner liner member and outer support cap need not necessarily be applied in the above order but may be applied simultaneously or in any other appropriate manner. Heating sealing is effected by using radio frequency energy which heats and melts the thermoplastic bonding material. The body member liner layer 20 is a thermoplastic material, such as polyethylene, polypropylene or the like, so that a heat seal bond may be effected between the closure member flange portion **4*b* and the body member inner liner layer 20. The support can inner liner layer 32 is also formed of a thermoplastic material to effect a heat seal bond between the support cap skirted portion 6*b* and the outer surface of the body member 2. If the metal foil layers 26 and 34** are not included or are replaced by suitable plastic materials, heat sealing of the container end may be effected dielectrically. Composite materials, such as those described in the preferred embodiment, which have a surface layer of thermoplastic material are desirable because the extra process step of applying adhesive material to the bonding area is eliminated.

While the preferred embodiment has been described, it will be understood that modifications and variations may be effected without departing from the spirit and scope of the novel concepts of this invention.

What is claimed is:

1. An improved composite container for liquids, such as oil, comprising (a) a tubular vertically-arranged composite body member including at least one fibrous body wall layer, and an inner liner layer;

(b) a membrane-type end closure member closing the bottom end of said body member, said end closure member being formed of a flexible relatively thin material and including a horizontal planar disk-shaped central panel portion extending transversely across the lower extremity of said body member, and an annular peripheral flange portion extending upwardly from the peripheral edge of said central panel portion, said flange portion being arranged concentrically within, and bonded to the inner circumferential surface of, said body member, the lower surface of said end closure central panel portion being generally coplanar with the lower extremity of said tubular body member; and (c) an outer support cap mounted in protective supporting relation below said closure member, said support cap having at least one fibrous layer and including a horizontal planar disk-shaped central panel portion in contiguous engagement with the lower extremity of said tubular body member, and an annular peripheral flange portion extending upwardly concentrically about, and bonded to the external surface of, the lower end of said body member, the central panel portion of said outer support cap extending in contiguous supporting relation below the central panel portion of said membrane-type end closure member.

2. A container as defined in claim 1, wherein the bond between the flange portion of said closure member and the inner surface of said body member is a heat sealed bond.

3. A container as defined in claim 2, wherein at least one of the adjacent surfaces of said body and end closure surfaces includes a heat sealable material.

4. A container as defined in claim 3, wherein said end closure member includes a layer of metal foil.

5. A container as defined in claim 4, wherein the bond between said end closure and body members is produced by radio frequency energy.

6. A container as defined in claim 4, wherein the bond between said end closure and body members is produced by dielectric heating.

7. A container as defined in claim 4, wherein the bond between said end closure and body members is produced by conduction heat sealing.

8. A container as defined in claim 3, wherein the bond between the flange portion of said support cap and the outer surface of said body member is a heat sealed bond.

9. A container as defined in claim 8, wherein said support cap includes a metal foil layer.

10. A container as defined in claim 9, wherein the bond between the support cap and the body member is produced by radio frequency energy.

11. A container as defined in claim 9, wherein the bond between the support cap and the body member is produced by dielectric heating.

12. A container as defined in claim 9, wherein the bond between the support cap and the body member is produced by conduction heat sealing.

* * * * *